United States Patent [19]

Shibuya et al.

[11] Patent Number: 4,507,065

[45] Date of Patent: Mar. 26, 1985

[54] VANE COMPRESSOR HAVING DRIVE SHAFT JOURNALLED BY ROLLER BEARINGS

[75] Inventors: Tsunenori Shibuya; Teruo Nakamura, both of Konan, Japan

[73] Assignee: Diesel Kiki Co., Ltd., Saitama, Japan

[21] Appl. No.: 491,858

[22] Filed: May 5, 1983

[30] Foreign Application Priority Data

May 13, 1982 [JP] Japan ..... 57-70019[U]
May 21, 1982 [JP] Japan ..... 57-74332[U]

[51] Int. Cl.[3] ..... F04C 18/00; F04C 29/02

[52] U.S. Cl. ..... 418/15; 418/76; 418/77; 418/81; 418/82; 418/93; 418/99; 418/268

[58] Field of Search ..... 418/76, 77, 81, 82, 418/93, 99, 15, 268; 184/6.16

[56] References Cited

U.S. PATENT DOCUMENTS 2,057,381 10/1936 Kenney et al. ..... 418/77
3,480,204 11/1969 Harlin ..... 418/82
4,144,002 3/1979 Shibuya et al. ..... 418/76

FOREIGN PATENT DOCUMENTS 53-131508 11/1978 Japan ..... 418/93

*Primary Examiner*—John J. Vrablik
*Attorney, Agent, or Firm*—Frishauf, Holtz, Goodman and Woodward

[57] ABSTRACT

A sealing chamber is defined between the front head and the front side block, and an oil chamber between the rear side block and a partition member secured to the rear end face of the rear side block, respectively. The drive shaft, on which the rotor is rigidly fitted, is radially supported by a pair of roller bearings provided at the front and rear side blocks. The bearings have end portions remote from the rotor enclosedly disposed in the sealing chamber and the oil chamber. The lubricating oil feeding system includes lubricating oil feeding bores formed in the front and rear side blocks and communicating with a zone under discharge pressure, and clearances between the front and rear side blocks and opposed end faces of the rotor. The clearances have predetermined flow resistance, and communicate, on one hand, with the back pressure chamber formed within the rotor, and on the other hand, with the sealing chamber and the oil chamber by way of the above roller bearings.

13 Claims, 8 Drawing Figures

VANE COMPRESSOR HAVING DRIVE SHAFT JOURNALLED BY ROLLER BEARINGS

BACKGROUND OF THE INVENTION

This invention relates to a refrigerant compressor primarily for use in an air conditioning system for automotive vehicles, and more particularly to a vane compressor which employs roller bearings to support the drive shaft and has improved lubrication of various sliding portions of the compressor.

Vane compressors are widely employed as refrigerant compressors in air conditioning systems for automotive vehicles, in general, by virtue of their simple construction and adaptability to operation at high rotational speeds. A typical conventional vane compressor of this kind comprises a pump housing formed of a cam ring and front and rear side blocks secured to opposite ends of the cam ring, and accommodating therein a rotor and vanes, a front head to which the front side block is secured, a drive shaft extending through the front and rear side blocks and the front head and journalled by two radial plane bearings formed, respectively, on the front and rear side blocks, and a drive shaft-seal means arranged in a sealing chamber formed in the front head and fitted on the drive shaft to seal same against the front head.

In this conventional vane compressor, the front and rear side blocks are each formed with a radially extending lubricating oil feeding bore and an axially extending oil passage. The lubricating oil feeding bores each have one end opening in the discharge pressure chamber and the other end opening in the surface of the associated radial bearing disposed in sliding contact with the drive shaft. One of the oil passages communicates the sealing chamber with a back pressure chamber which communicates with the bottom of each of the vanes, while the other oil passage communicates an oil chamber disposed to enclose the rear end of the drive shaft with the back pressure chamber. During operation of the compressor, lubricating oil in the discharge pressure chamber is guided through each of the lubricating oil feeding bores and then the clearances between the drive shaft and the radial bearings to be fed into the sealing chamber on one hand, and into the oil chamber on the other hand, to lubricate the sliding surfaces of the above parts. The lubricating oil in the above clearances is also guided to the back pressure chamber to impart a predetermined back pressure to the vanes.

According to the above lubricating feeding system, the lubricating oil under high pressure, stored in the discharge pressure chamber is reduced in pressure by the flow resistance acting upon the lubricating oil as it travels through the clearances between the drive shaft and the plane bearings, so as to impart a required level of pressure to the sealing chamber and the back pressure chamber. In order to achieve such required level of pressure with accuracy, it requires close tolerances in machining the surfaces of the drive shaft and the plane bearings in sliding contact with each other, as well as in assembling these parts. Further, the plane bearings are apt to undergo insufficient lubrication of their sliding surfaces, often resulting in seizure of the bearings and the drive shaft. In addition, extraneous matters can be intruded into the clearances between the bearings and the drive shaft, which also can cause seizure of these parts. Still further, plane bearings in general are inferior to roller bearings in respect of energy consumption.

Moreover, the sealing chamber and the oil chamber are supplied with lubricating oil having a high pressure at substantially the same level with the back pressure acting upon the vanes, and having a high temperature, which is heated due to the compressed refrigerant, causing insufficient lubrication and cooling of the bearings and the drive shaft-seal means, as well as leakage of lubricating oil and refrigerant through the sealing chamber.

OBJECTS AND SUMMARY OF THE INVENTION

It is an object of the invention to provide a vane compressor in which the drive shaft is radially supported by roller bearings to thereby prevent seizure and insufficient lubrication of the same bearings, as well as to achieve high productivity and efficiency of the compressor.

It is a further object of the invention to provide a vane compressor which is constructed such that the sealing chamber and the oil chamber are directly supplied with refrigerant having a low pressure and a low temperature, to thereby prevent seizure of the drive shaft-seal means in the sealing chamber and the radial bearings, as well as leakage of lubricating oil and refrigerant through the sealing chamber.

The present invention provides a vane compressor which comprises a sealing chamber defined between the front head and the front side block, and an oil chamber defined between the rear side block and a partition member secured to the end face of the rear side block remote from the rotor, the rear side block cooperating with the front side block and the cam ring to form the pump housing. A suction chamber is formed between the front head and the front side block and/or between the rear side block and the partition member, and communicates with pump working chambers on the suction stroke through pump inlets formed through at least one of the front and rear side blocks. The compressor casing, which is formed by the covering and the front head, is formed with the suction port and the discharge port. The drive shaft, on which the rotor is rigidly fitted, is partly disposed in the pump housing and journalled by a pair of roller bearings provided at the front and rear side blocks. The roller bearings have end portions remote from the rotor enclosedly disposed in the sealing chamber and the oil chamber, respectively. The rotor has its interior formed with a back pressure chamber and opposite end faces disposed in sliding contact with or close proximity to the front and rear side blocks.

The lubricating oil feeding system comprises lubricating oil feeding bores formed in the front side block and the rear side block and having one ends communicating with a zone under discharge pressure, and fine clearances between the opposite end faces of the rotor and the front and rear side blocks in which open the other ends of the lubricating oil feeding bores. The clearances have predetermined flow resistance and communicate, on one hand, with the back pressure chamber, and on the other hand, with the sealing chamber and the oil chamber by way of the roller bearings.

The above and other objects, features and advantages of the invention will be more apparent from the ensuing detailed description taken in connection with the accompanying drawings.

DETAILED DESCRIPTION

Figure 1:
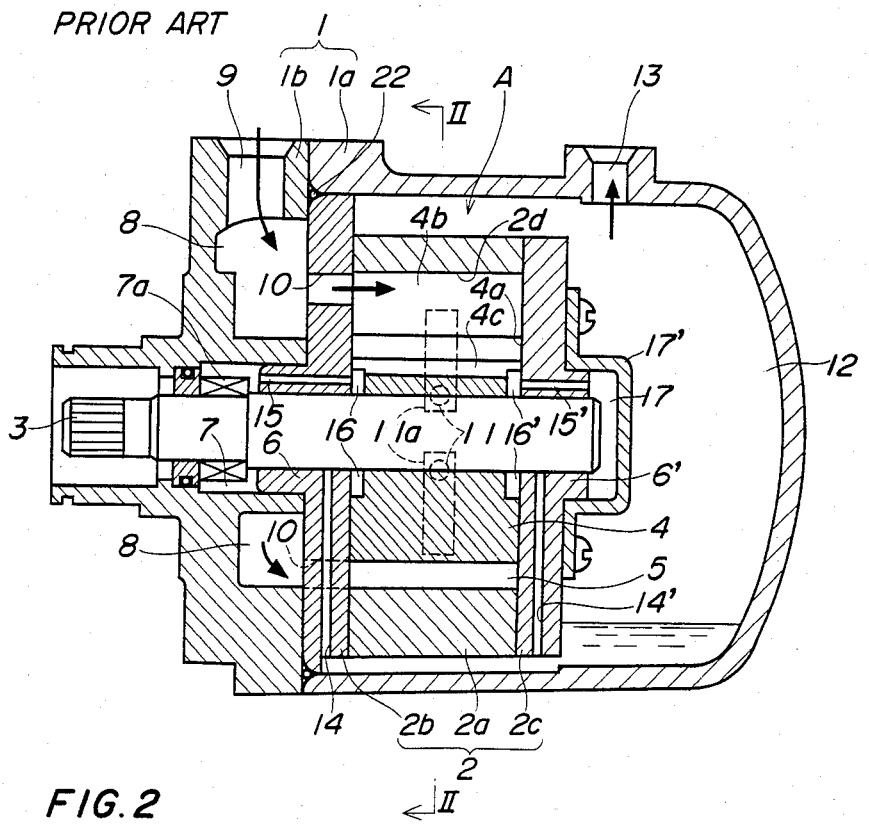
FIG. 1 PRIOR ART
FIG. 1 is a longitudinal vertical sectional view of a conventional vane compressor of the diametrically symmetrical double chamber type.
Figure 2:
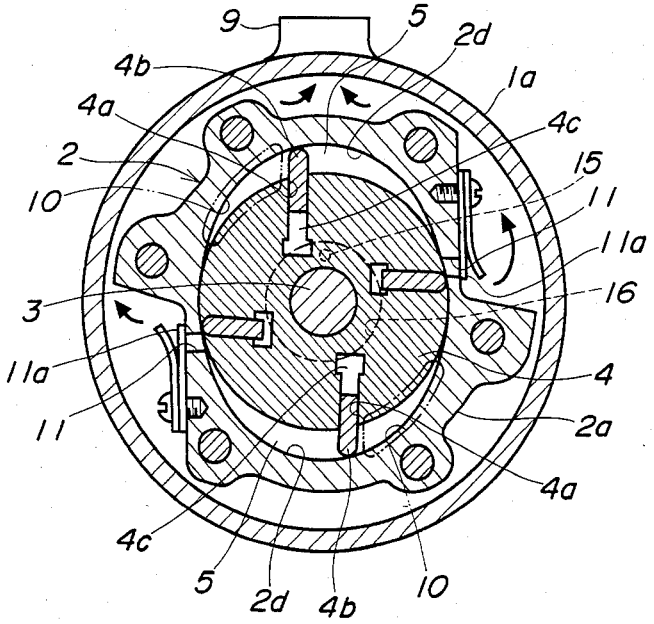
FIG. 2 PRIOR ART
FIG. 2 is a cross-sectional view taken along line II—II in FIG. 1.

Referring first to FIGS. 1 and 2, there is illustrated a conventional vane compressor of the symmetrical double chamber type. A compressor casing 1 is formed by a generally cylindrical covering 1*a* and a front head 1*b*, within which is accommodated a pump housing 2 formed of an ellipsoidal cam ring 2*a* and front and rear side blocks 2*b* and 2*c* secured, respectively, to the front and rear end faces of the cam ring 2*a*. The front side block 2*b* is fixed to the front head 1*b* in a manner that the pump housing 2 is supported by the front head 1*b*. The covering 1*a* is joined to the front head 1*b* by means of bolts, not shown, with its open end abutting against the front head 1*b* in a gastight manner with an annular sealing member 22 interposed therebetween. The pump housing 2 accommodates a cylindrical rotor 4 rigidly fitted on a drive shaft 3, which cooperates with the pump housing 2 to form a pump assembly A and has a plurality of axial slits 4*a* formed in its outer peripheral surface and carries as many plate-like vanes 4*b* fitted in the slits 4*a* for radial movement. Pump working chambers 5 are defined between the rotor 4, adjacent vanes 4*b*, the endless camming inner peripheral surface 2*d* of the cam ring 2*a*, and the inner end faces of the opposite front and rear side blocks 2*b*, 2*c*. The drive shaft 3 extends through the front side block 2*b* and the rear side block 2*c*, and journalled by front and rear radial plane bearings 6 and 6′ formed integrally with the front and rear side blocks 2*b* and 2*c*, respectively. A sealing chamber 7 is formed within the front head 16, and defined by the front head 1*b* and the front side block 2*b*. A drive shaft-seal means 1*a* is arranged in the sealing chamber 7 and fitted on the drive shaft 3 which extends through the drive shaft-seal means 7*a*, in a gastight manner, to thus seal the drive shaft 3 against the front head 1*b*.

Disposed around the sealing chamber 7 in the front head 1*b* is a suction chamber 8 which is annular in shape and defined by the front head 1*b* and the front side block 2*b*. This suction chamber 8 communicates, on one hand, with a suction port 9 formed in an upper portion of the front head 1*b*, and on the other hand, with volume-increasing pump working chambers 5 on suction stroke, through pump inlets 10 formed through the front side block 2*b*. The volume-decreasing pump working chambers 5 on discharge stroke can communicate with a discharge pressure chamber 12 defined within the covering 1*a* at a rear side of the pump housing 2, by way of pump outlets 11 formed through the cam ring 2*a*, discharge valves 11*a*, and gaps between the pump housing 2 and the covering 1*a*, while the discharge pressure chamber 12 communicates with a discharge port 13 formed through an upper portion of the covering 1*a*.

Lubricating oil feeding bores 14 and 14′ are formed in the front side block 2*b* and the rear side block 2*c*, respectively, starting from lower peripheral surfaces of the respective side blocks and opening in inner peripheral surface of the respective plane bearings 6, 6′, while oil passages 15 and 15′ axially penetrate the respective bearings 6, 6′. On the other hand, the rotor 4 has its front and rear end faces formed with annular grooves 16 and 16′ disposed around the drive shaft 3, which both within the covering 1*a* at a rear side of the pump housing 2, by way of pump outlets 11 formed through the cam ring 2*a*, discharge valves 11*a*, and gaps between the pump housing 2 and the covering 1*a*, while the discharge pressure chamber 12 communicates with a discharge port 13 formed through an upper portion of the overing 1*a*.

Lubricating oil feeding bores 14 and 14′ are formed in the front side block 2*b* and the rear side block 2*c*, respectively, starting from lower peripheral surfaces of the respective side blocks and opening in inner peripheral surface of the respective plane bearings 6, 6′, while oil passages 15 and 15′ axially penetrate the respective bearings 6, 6′. On the other hand, the rotor 4 has its front and rear end faces formed with annular grooves 16 and 16′ disposed around the drive shaft 3, which both communicate with a back pressure chamber 4*c* formed within the rotor 4, the back pressure chamber 4*c* in turn communicating with the bottoms of the slits 4*a*. The above-mentioned oil passage 15 communicates the annular groove 16 on the front side with the sealing chamber 7, while the other oil passage 15′ communicates the other annular groove 16′ on the rear side with an oil chamber 17 defined within a covering plate 17′ which is secured to the rear side block 2*c* in a manner covering a rear end face of the same block 2*c* formed with the bearing 6′.

With the above described conventional arrangement, when the drive shaft 3 rotates, which is usually rotated in unison with an engine, not shown, on an associated automotive vehicle, not shown, and accordingly the rotor 4 also rotates, the vanes 4*b* rotate together with the rotor 4 while radially moving with their tips sliding on the camming inner peripheral surface 2*d* of the cam ring 2*a* due to centrifugal force and back pressure caused by the lubricating oil. As each pump working chamber 5 goes through the suction stroke, refrigerant is forcedly introduced into the suction chamber 8 through the suction port 9, and sucked into the same chamber 5 through the corresponding pump inlet 10, while as the chamber 5 goes through the compression stroke, the suction refrigerant is compressed. At the subsequent discharge stroke, the compressed refrigerant is discharged into the discharge pressure chamber 12 through the pump outlets 11 and the forcedly opened discharge valves 11*a*, for temporary storage therein. Thereafter, the discharge refrigerant is supplied into the refrigerating circuit, not shown, through the discharge port 13. The above suction, compression and discharge strokes are repeatedly carried out to perform a refrigerant compressing action.

The lubricating oil mixed in the refrigerant is separated from the refrigerant in the discharge pressure chamber 12 and stored at the bottom of the same chamber 12. Due to high discharge pressure in the discharge pressure chamber 12, the lubricating oil at the bottom of the chamber 12 is forcedly guided along the lubricating oil feeding bores 14, 14'. The lubricating oil in the bore 14 formed in the front side block 2b then travels through a small clearance between the bearing 6 on the front side and the drive shaft 3, where it is divided into two axially opposite flows to lubricate the bearing 6. One of the two flows is guided into the sealing chamber 7 and the other flow into the annular groove 16 on the front side. The lubricating oil guided into the sealing chamber 7 lubricates the drive shaft-seal means 7a therein and then guided into the annular groove 16 on the front side through the oil passage 15, part of which flows into the back pressure chamber 4c to impart back pressure to radially inward end faces of the vanes 4b, and the other part is forced into the gap between the rotor 4 and the front side block 2b to lubricate their sliding surfaces and then into the pump working chambers 5. On the other hand, another part of the lubricating oil stored at the bottom of the covering 1a and forcedly fed through the lubricating oil feeding bore 14' formed in the rear side block 2c flows into a small clearance between the bearing 6' on the rear side and the drive shaft 3, where it is divided into two axially opposite flows to lubricate the same bearing 6'. The lubricating oil in the clearance is delivered into the annular groove 16' directly or by way of the oil chamber 17 and the oil passage 15'. After this, it is guided into the back pressure chamber 4c to impart back pressure to the vanes 4b and forced into the gap between the rotor 4 and the rear side block 2c to lubricate their sliding surfaces and then into the pump working chambers 5. In the pump working chambers 5, the lubricating oil lubricates the sliding surfaces of the vanes 4b and the pump housing 2, and discharged into the discharge pressure chamber 12 together with the discharge refrigerant, where it is again separated from the refrigerant and stored in the bottom of the chamber 12. In this manner, the above described cycle of lubricating oil is repeated.

The conventional vane compressor described above is so constructed that lubricating oil has its pressure reduced to a certain level as it travels through the fine clearances between the plane bearings 6, 6' and the drive shaft 3 to the sealing chamber 7, the oil chamber 17, and the back pressure chamber 4c due to the flow resistance that acts upon the lubricating oil while it travels in the above clearances, so as to apply an appropriate level of back pressure to the vanes 4b, as well as to minimize leakage of the lubricating oil through the drive shaft seal-means 7a. Therefore, it has conventionally been considered that functionally the use of plane bearings in vane compressors of this kind is inevitable. However, in such conventional vane compressors employing plane bearings for supporting the drive shaft, it requires close tolerances to machine the sliding surfaces of the drive shaft and the bearings and assemble these parts so as to provide accurate required clearances between the two parts. In addition, there is a problm of seizure of the sliding surfaces of the drive shaft and the plane bearings due to insufficient lubrication of the sliding surfaces and intrusion of extraneous matters into the clearances, as well as a problem of low efficiency, i.e. high energy consumption.

If the plane bearings are simply replaced by roller bearings in order to solve the above-mentioned problems, the flow resistance that the lubricating oil undergoes while passing through the roller bearings is very small, that is, much smaller than that of the plane bearings, so that a desired drop in the pressure of the lubricating oil cannot be obtained, making it impossible to supply an appropriate reduced oil pressure to the sealing chamber, the oil chamber and the back pressure chamber.

Further, the supply of hot lubricating oil having not a low pressure, heated by the compressed refrigerant to the sealing chamber 7 and the oil chamber 17 can result in insufficient lubrication and cooling of the drive shaft-seal means 7a and the plane bearings 6, 6', causing leakage of lubricating oil and refrigerant gas through the drive shaft-seal means 7a, as well as seizure of the plane bearings on its peripheral parts.

The vane compressors according to the present invention will now be described with reference to FIGS. 3 through 8 illustrating several embodiments of the invention. In these figures, corresponding parts and elements to those in the conventional vane compressor in FIG. 1 and 2 are designated by indentical reference numerals.

Figure 3:
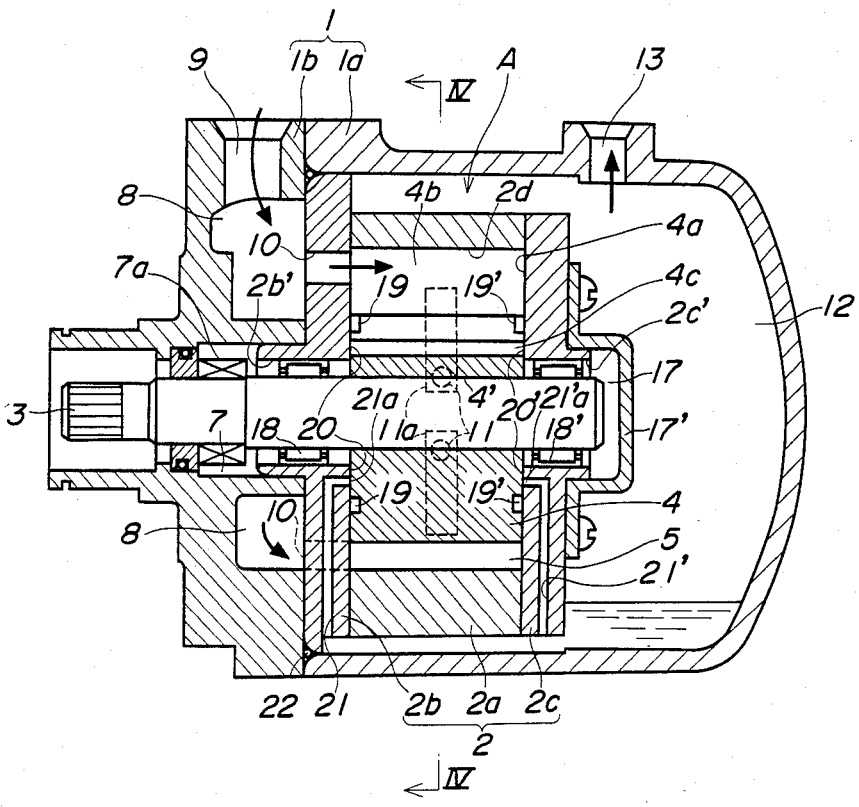
FIG. 3 is a longitudinal vertical sectional view of a vane compressor according to a first embodiment of the present invention.
Figure 4:
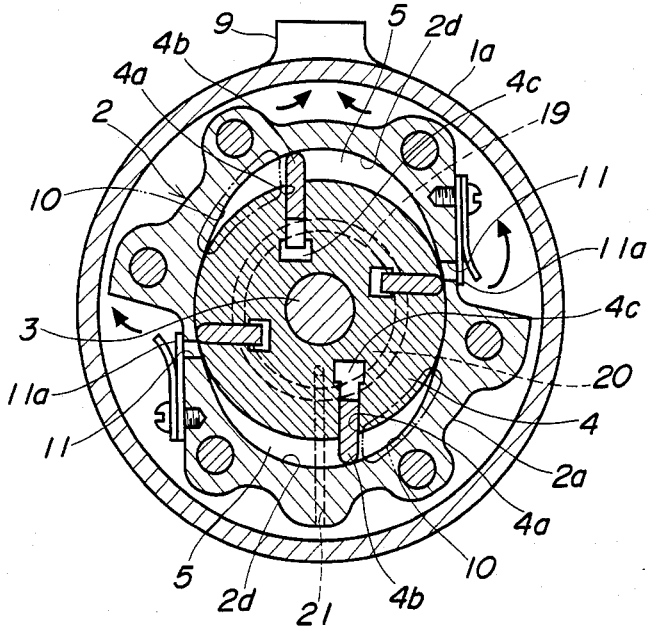
FIG. 4 is a cross-sectional view of the vane compressor, taken along line IV—IV in FIG. 3.

Referring first to FIGS. 3 and 4, there is illustrated a first embodiment of the invention. This embodiment is different from the conventional vane compressor of FIGS. 1 and 2 mainly in that roller bearings 18 and 18' are fitted in the front and rear side blocks 2b, 2c, in place of the plane bearings 6, 6' in FIGS. 1 and 2, and no oil passage is formed in either of the side blocks 2b, 2c, which correspond to the oil passages 15, 15' in FIGS. 1 and 2 which communicate the sealing chamber 7 and the oil chamber 17 with the annular grooves 16, 16'.

The roller bearings 18, 18' are received within shaft holes 2b', 2c' formed, respectively, through the front and rear side blocks 2b, 2c. Since the shaft holes 2b', 2c' merely receive therein the roller bearings 18, 18', they do no require so close machining tolerances as the drive shaft-fitted bores of the plane bearings 6, 6' in FIGS. 1 and 2.

Further, in order to supply lubricating oil at required levels of pressure to various portions in the compressor employing the roller bearings 18, 18', the rotor 4 has its opposite end faces formed with a pair of annular grooves 19 and 19' at a location radially spaced from a drive shaft-fitted through bore 4' formed in the rotor 4, and communicating with the back pressure chamber 4c, and also formed with annular sliding surfaces 20 and 20' at a location radially inward of the annular grooves 19, 19', that is, radially extending between the annular grooves 19, 19' and the through bore 4'. The annular sliding surfaces 20, 20' are each disposed opposite the inner end face of the corresponding side block 2b, 2c with a fine clearance provided therebetween, which clearance communicates, on one hand, with the annular groove 19, 19', and on the other hand, with the shaft hole 2b', 2c' formed through the side block 2b, 2c. Lubricating oil feeding bores 21 and 21', each having a L-shaped cross section, are formed, respectively, in the front and rear side blocks 2b, 2c, starting at one ends from the lower peripheral surfaces of the respective side blocks and radially extending in the side blocks and then axially inwardly extending to open, at the other ends, in the clearances between the side blocks and the sliding surfaces 20, 20' at a location substantially radially central between the drive shaft 3 and the respective annular grooves 19, 19'.

The other parts and elements of the vane compressor of this embodiment, not referred to above, are substantially identical in construction and arrangement with corresponding ones in FIGS. 1 and 2, description of which is therefore omitted.

The operation of the vane compressor of the embodiment of FIGS. 3 and 4 is as follows: As the drive shaft 3 and accordingly the rotor 4 rotate in unison with the engine of an associated vehicle, not shown, on a like prime mover, a refrigerant compressing action comprising suction, compression and discharge strokes is effected in a manner similar to that of the compressor of FIGS. 1 and 2. Simultaneously with this refrigerant compressing action, lubricating oil which has been separated from refrigerant in the discharge pressure chamber 12 and stored at the bottom of the casing 1*a* is forcedly guided in the lubricating oil feeding bores 21, 21' due to high pressure in the discharge pressure chamber 12, and delivered to the clearance between the front side block 2*b* and the sliding surface 20, and that between the rear side block 2*c* and the sliding surface 20' at a substantially radial central location of the same clearances. The lubricating oil thus delivered into each of the clearances is divided into radially opposite flows, the radially inward one of which is guided toward the associated roller bearing 18, 18', while the other or radially outward flow is guided toward the associated annular groove 19, 19'. Since the clearances are set to a very small value, as noted previously, the lubricating oil undergoes large flow resistance due to the small clearances as it travels through the same clearances in either of the radially outward and inward directions, so that the pressure of the lubricating oil is reduced from an initial level of discharge pressure to a lower or required back pressure level. The lubricating oil introduced into the roller bearing 18 on the front side passes through the same bearing while maintaining its pressure at the above required back pressure level, into the sealing chamber 7 to lubricate and cool the drive shaft-seal means 7*a* therein. On the other hand, the lubricating oil introduced into the roller bearing 18' on the rear side is also guided into the oil chamber 17 while maintaining its pressure at the required back pressure level. By virtue of the use of the roller bearings 18, 18' in lieu of plane bearings, the possibility of seizure of the bearings and its peripheral parts is reduced to a minimum, even if it is so adjusted that the pressure and temperature of the lubricating oil supplied to the roller bearings 18, 18' are substantially the same as those in the conventional compressor of FIGS. 1 and 2.

On the other hand, the lubricating oil guided to the annular grooves 19, 19' is then delivered to the back pressure chamber 4*c* to apply pressure having the required back pressure level to the vanes 4*b* in the same manner as in the compressor of FIGS. 1 and 2, and then, due to the pressure difference between the back pressure chamber 4*c* and the pump working chambers 5 on the suction stroke, it is guided through clearances between the rotor 4 and the side blocks 2*b*, 2*c* as well as clearances between the rotor 4 and the vanes 4*b* while lubricating the sliding surfaces of these parts, into the above pump working chambers 5, followed by being discharged together with compressed refrigerant into the discharge pressure chamber 12.

Figure 5:
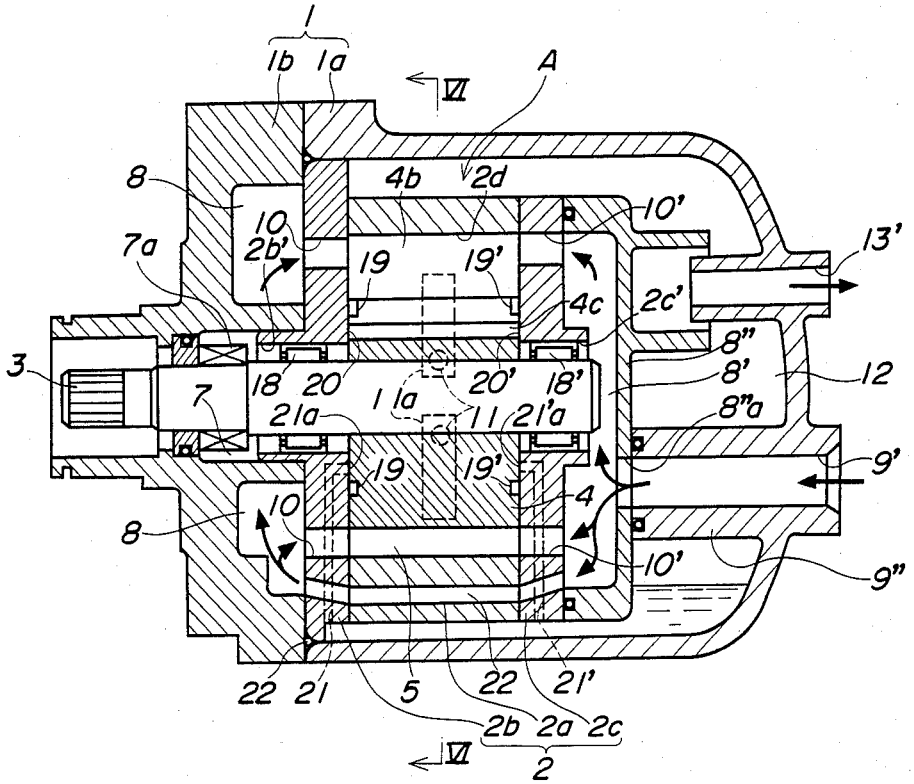
FIG. 5 is a longitudinal vertical sectional view of a vane compressor according to a second embodiment of the invention.
Figure 6:
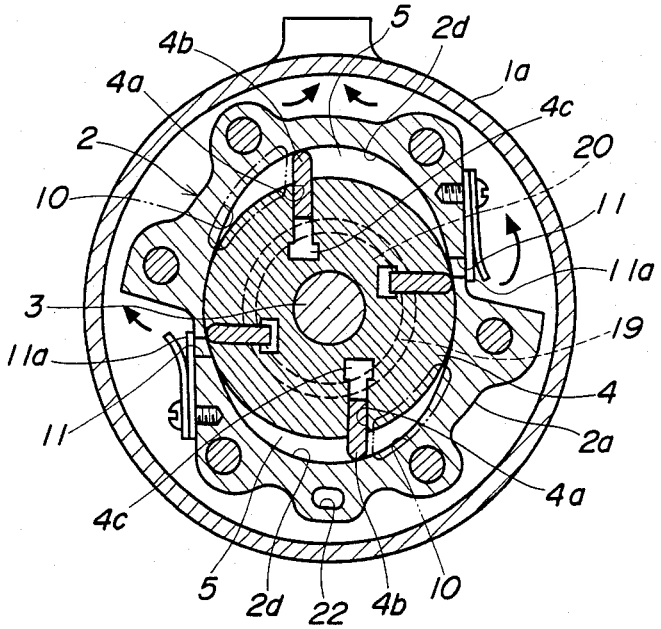
FIG. 6 is a cross-sectional view of the vane compressor, taken along line VI—VI in FIG. 5.

FIGS. 5 and 6 illustrate a second embodiment of the invention. According to this embodiment, a suction port 9' and a discharge port 13', which supersede the suction port 9 and the discharge port 13 in the preceding figures, are formed in the rear end wall of the covering 1*a*, whereas a generally dished partition member 8'' is secured to the rear end face of the rear side block 2*c* so as to define therebetween a rear suction chamber 8', while a front suction chamber 8, which is devoid of a suction port, is defined between the front head 1*b* and the front side block 2*b*. The above suction port 9' is communicated with the rear suction chamber 8' by means of a hollow passage defining portion 9'' formed integrally with the rear end wall of the covering 1*a* and defining therein a communication passage. That is, the hollow passage defining portion 9'' has an inner end joined to the partition member 8'' in alignment with a through hole 8''*a* formed in the same member 8'' and the other or outer end integrally formed with the covering 1*a* in alignment with the suction port 9'. The front and rear suction chambers 8, 8' communicate with the pump working chambers on the suction stroke, respectively, through pump inlets 10 and 10' formed, respectively, through the front side block 2*b* and the rear side block 2*c*. Further, these suction chambers 8, 8' are communicated with each other by way of a suction passage 22 axially extending through a peripheral wall portion of the pump housing 2, that is, through the front side block 2*b*, the cam ring 2*a* and the rear side block 2*c*. It is to be noted that the rear suction chamber 8' also serves as an oil chamber corresponding to the one 17 in the embodiment of FIGS. 3 and 4.

The other parts and elements of the FIG. 5 and 6 embodiment, not referred to above, are substantially identical in construction and arrangement with corresponding ones in the preceding first embodiment, description of which is therefore omitted.

Although the operation of this embodiment and results produced thereby are substantially identical with those of the preceding first embodiment, this embodiment is advantageous over the first embodiment in that low pressure and low temperature suction refrigerant is first supplied into the rear suction chamber 8', and as a consequence, enhanced cooling of the outer end portion of the roller bearing 18' on the rear side is available.

Figure 7:
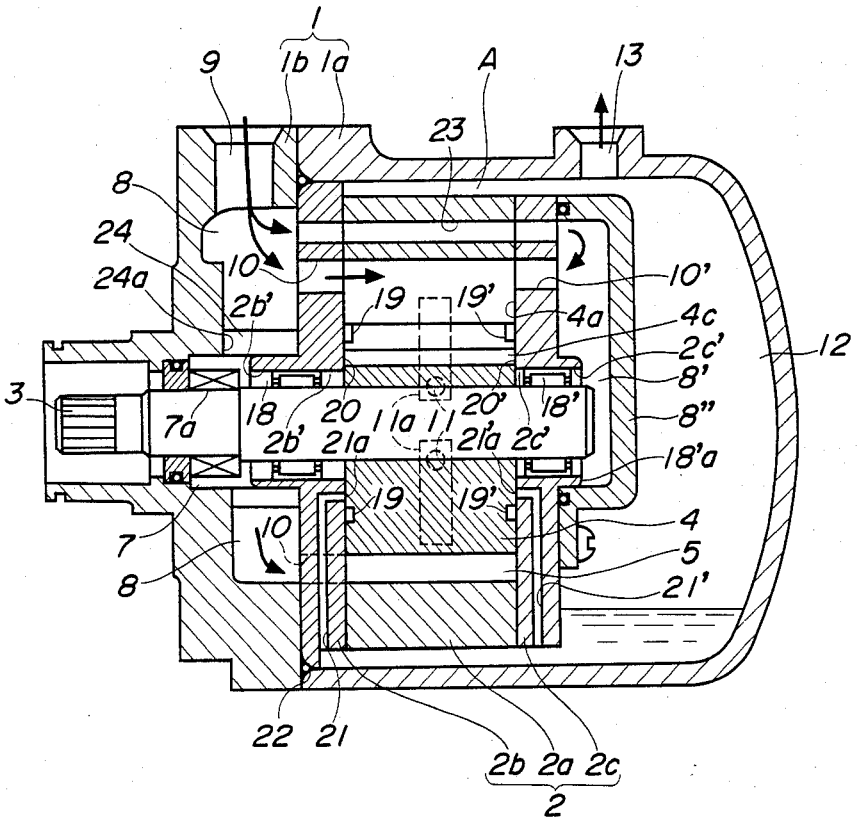
FIG. 7 is a longitudinal vertical sectional view of a vane compressor according to a third embodiment of the invention.

FIG. 7 illustrates a third embodiment of the invention. According to this embodiment, in addition to employment of roller bearings for radial supporting of the drive shaft, in place of the plane bearings in FIGS. 1 and 2, it is so arranged that low pressure and low temperature suction refrigerant is directly introduced into the vicinity of the outer end portions of the radial bearings. More specifically, the embodiment of FIG. 7 is distinguished from the first embodiment of FIGS. 3 and 4 mainly in that a cylindrical partition wall 24, which separates the front suction chamber 8 from the sealing chamber 7, is cut away in part to form a communicating opening 24*a* through which the sealing chamber 7 communicates directly with the front suction chamber 8. Alternatively of the illustrated embodiment, the partition wall may be wholly omitted, or may be formed with at least one radially extending through hole, to form a similar communicating opening.

On the other hand, a dished partition member 8'' is secured to the rear end face of the rear side block 2*c* to define a rear suction chamber 8' between the same partition member 8' and the rear side block 2*c*, in which is disposed the outer end portion of the rear-side roller bearing 18' remote from the rotor 4. The rear suction chamber 8' is communicated with the front suction chamber 8 by way of a suction passage 23 axially extending through a peripheral wall portion of the pump housing 2, that is, through the front side block 2b, the cam ring 2a and the rear side block 2c. Alternatively of this suction passage 23, a separate tubular member defining therein a through hole may be employed to communicate the two suction chambers 8, 8' with each other. The front and rear suction chambers 8, 8' communicate with pump working chambers 5 on the suction stroke, respectively, through front pump inlets 10 formed through the front side block 2b and through a rear pump inlet 10' formed through the rear side block 2c. As is the same with the embodiment of FIGS. 5 and 6, the rear suction chamber 8 also serves as an oil chamber enclosing the outer end portion of the rear-side bearing 18' remote from the rotor 4, corresponding to the oil chamber 17 in FIG. 3.

With the FIG. 7 arrangement, the sealing chamber 7 directly communicating with the front suction chamber 8 is subject to low pressure (about 2 kg/cm$^2$) of suction refrigerant which is introduced therein through the suction port 9 and the front suction chamber 8, whereas in the rear suction chamber 8', the outer end portion of the rear-side roller bearing 18' remote from the rotor 4 is subject to substantially the same low pressure of suction refrigerant, since the rear suction chamber 8' communicates with the front suction chamber 8 via the suction passage 23.

In the FIG. 7 embodiment, the lubricating oil feeding system, which includes oil flow lines between the lubricating oil feeding bores 21, 21' and the sealing chamber 7, the rear suction chamber 8' and the back pressure chamber 4c, has a similar construction to that of the first embodiment of FIGS. 3 and 4, except that the lubricating oil feeding bores 21, 21' each have its open end 21a, 21'a opening in the clearance between the annular sliding surface 20, 20' and the corresponding side block 2b, 2c, not at a radially central location of the same clearance but at a location radially outward of the central location, i.e. toward the annular groove 19, 19'. To be concrete, the location of the open end 21a, 21'a of each oil feeding bore 21, 21' is set such that the distance between the same open end and the annular groove 19, 19' is smaller than that between the same open end and the corresponding shaft hole 2b', 2c', so as to set the flow resistance occurring in the clearance between the open end 21a, 21'a and the shaft hole 2b', 2c' to such a value as to reduce the lubricating oil pressure or discharge pressure to a suction pressure level, as well as to set the flow resistance occurring in the clearance between the open end and the annular groove 19, 19' to such a value as to reduce the lubricating oil pressure to a back pressure level. Alternatively of adjusting the distance between the open end and the shaft hole or the annular groove to set the flow resistance as illustrated embodiment, the clearance size between the sliding surface 20, 20' and the side block 2b, 2c may be adjusted.

The other parts and elements not referred to the above in the present embodiment are substantially the same in construction and arrangement with corresponding ones in the preceding embodiments, description of which is therefore omitted.

The vane compressor of the FIG. 7 embodiment operates as follows: As the drive shaft 3 rotates in unison with the engine of an associated vehicle or a like prime mover, refrigerant having a relatively low temperature is introduced into the front suction chamber 8 through the suction port 9 and then into the sealing chamber 7 through the communicating opening 24a. Thus, the internal pressure of the sealing chamber 7 is maintained within a low suction pressure range (about 2 kg/cm$^2$), and the drive shaft-seal means 7a and the front-side roller bearing 18, both in the sealing chamber 7, are cooled by the suction refrigerant. On the other hand, the suction refrigerant introduced into the sealing chamber 7 as well as the greater part of the rest of suction refrigerant introduced into the front suction chamber 8 is sucked into pump working chambers 5 on the suction stroke through the front pump inlets 10. The remaining part of the suction refrigerant introduced into the front suction chamber 8 is guided into the rear suction chamber 8' through the suction passage 23 so that the pressure in the vicinity of the outer end portion 18'a of the rear-side roller bearing 18' remote from the rotor 4 is maintained within the low suction pressure range, and also the same roller bearing 18' is cooled by the suction refrigerant. The suction refrigerant introduced into the rear suction chamber 8, is sucked into a pump working chamber 5 on the suction stroke through the rear pump inlet 10'. Thereafter, the refrigerant suction, compression, and discharge strokes and the supply of discharge refrigerant into the refrigerating circuit, not shown, are carried out in the same manner as in the first embodiment.

On the other hand, the lubricating oil which has been separated from refrigerant in the discharge pressure chamber 12 is forcedly guided through the lubricating oil feeding bores 21, 21' in the same manner as in the first embodiment, and it is then delivered into the clearances between the sliding surfaces 20, 20' of the rotor 4 and the front and rear side blocks 2b, 2c. In the clearances, the flow of lubricating oil is divided into two radially opposite flows, one of which flows to the roller bearings 18, 18', while the other flow flows to the annular grooves 19, 19'. As previously noted, as distinct from the first embodiment, the above clearances extending between the open ends 21a, 21'a of the feeding bores 21, 21' and the shaft bores 2b', 2c' in which the roller bearing 18, 18' are fitted are set at such a value that the flow resistance occurring in these clearances has such a relatively large value, as compared with that in the first embodiment, that the pressure of the lubricating oil which initially assumes the discharge pressure is reduced to a value within the suction pressure range as the lubricating oil travels to the roller bearings 18, 18'. Whilst, the lubrication and cooling of the various sliding portions as well as the manner of application of back pressure to the vanes 4b are effected in similar manners to those described with respect to the first embodiment, description of which is therefore omitted.

Figure 8:
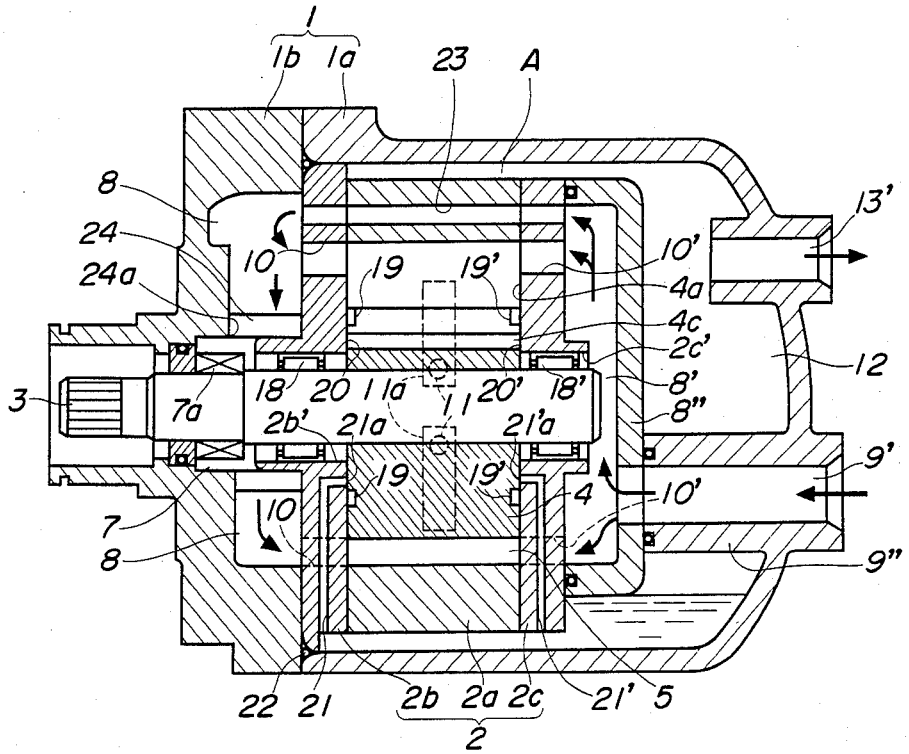
FIG. 8 is a longitudinal vertical sectional view of a vane compressor according to a fourth embodiment of the invention.

FIG. 8 illustrates a fourth embodiment of the invention. According to this embodiment, the covering 1a has its read end wall formed with the suction port 9' and the discharge port 13' in the same manner as in the second embodiment, and it comprises front and rear suction chambers 8, 8', both communicating with the suction port 9', and a communicating opening 24a communicating the front suction chamber 8 with the sealing chamber 7, for introducing low pressure and low temperature suction refrigerant directly into a zone in the vicinity of the outer end portions of the roller bearings 18, 18' as well as the drive shaft-seal means 7a, in the same manner as in the third embodiment. The other parts and elements, not referred to above, are substantially identical with those in the first embodiment. Also, the operation of the present embodiment is substantially identical with the operations of the preceding embodiments. Therefore, further description is omitted in respect of construction, arrangement and operation.

As set forth above, the vane compressors according to the invention can produce the following excellent results:

(1) Since the rotor 4 has its opposite end faces formed with annular grooves 19, 19', both communicating with the back pressure chamber 4*c*, as well as annular sliding surfaces 20, 20' disposed in sliding contact with or in close proximity to the front and rear side blocks 2*b*, 2*c* and located radially inwardly of the annular grooves 19, 19', wherein the lubricating oil feeding bores 21, 21' open in the clearances between the above sliding surfaces 20, 20' and the opposed side blocks 2*b*, 2*c*, lubricating oil with its pressure reduced to a suitable value is supplied to the sealing chamber 7 and the back pressure chamber 4*c*, making it possible to employ roller bearings 18, 18' for radially supporting the drive shaft 3, which have conventionally been considered difficult to employ.

(2) Since the drive shaft 3 is thus journalled by the roller bearings 18, 18', seizure of the bearing portions can be prevented, also reducing the friction loss of the bearings as well as the energy loss of same. Moreover, as distinct from the case of using plane bearings, close-tolerance machining and assembling of the bearings is unnecessary, thereby achieving high productivity.

(3) By virtue of the arrangement of the drive shaft-seal means and the outer end portions of the roller bearings in the sealing chamber and the rear suction chamber, both communicating with the suction port, for introducing low pressure and low temperature suction refrigerant into these chambers, the roller bearings and the drive shaft-seal means are subject to direct contact with the suction refrigerant to thereby achieve sufficient cooling of same as well as to prevent seizure of same. Further, since the internal pressure within the drive shaft-seal means and the rear suction chamber is maintained at a low value, thereby preventing leakage of refrigerant gas as well as leakage of lubricating oil therethrough.

Although the preceding embodiments are applied to vane compressors of the diametrically symmetrical double chamber type, the invention may of course be applied to the single chamber type as well as to the multi-chamber type, as well.

Obviously many modifications and variations of the present invention are possible in the light of the above teachings. It is therefore to be understood that within the scope of the appended claims the invention may be practiced otherwise than as specifically described.

What is claimed is:

1. A vane compressor comprising: a cam ring having an endless camming inner peripheral surface and opposite ends; front and rear side blocks secured to said opposite ends of said cam ring and forming a pump housing in cooperation with said cam ring, said pump housing having at least one pump inlet and at least one pump outlet, said pump inlet being formed through at least one of said front and rear side blocks; a cylindrical rotor accommodated within said pump housing, said rotor having an outer peripheral surface thereof formed with a plurality of slits, and having an interior thereof formed with a back pressure chamber communicating with said slits, said rotor having opposite end faces disposed in close proximity to said front and rear side blocks; a plurality of vanes radially slidably fitted in said slits of said rotor for sliding on said endless camming inner peripheral surface of said cam ring, adjacent ones of said vanes cooperating with said pump housing and said rotor to define therebetween pump working chambers communicating with said pump inlet or said pump outlet; a front head secured to said front side block, said rear side block having an end face remote from said rotor; a drive shaft partly disposed in said pump housing and supporting said rotor; a covering cooperating with said front head to form a compressor casing, said compressor casing having a suction port and a discharge port formed therein, said suction port communicating with said pump inlet of said pump housing, said discharge port being disposed for communication with said pump outlet of said pump housing; a partition member secured to said end face of said rear side block and cooperating with said rear side block to define an oil chamber therebetween; at least one suction chamber defined by at least one of a pair of said front head and said front side block and a pair of said rear side block and said partition member, said suction chamber communicating with at least one of said pump working chambers on a suction stroke thereof through said pump inlet; first and second roller bearings arranged in said front and rear side blocks and radially supporting said drive shaft, said roller bearings each having an end portion remote from said rotor, one of said roller bearings having said end portion disposed in said oil chamber; a sealing chamber defined by said front head and said front side block and penetrated by said drive shaft, the other of said roller bearings having said end portion disposed in said sealing chamber; and lubricating oil feeding means including first and second lubricating oil feeding passages formed in said front and rear side blocks and each having one end communicating with oil in a zone under discharge pressure, first and second clearances defined between said opposite end faces of said rotor and said front and rear side blocks, said first and second lubricating oil feeding passages each having another end opening in a corresponding one of said first and second clearances, said first and second clearances communicating, on one hand, with said back pressure chamber, and on the other hand, with a corresponding one of said sealing chamber and said oil chamber, through a corresponding one of said roller bearings; said first and second clearances each have a portion extending between said another end of a corresponding one of said lubricating oil feeding passages and said back pressure chamber, said portion of each of said first and second clearances being adapted to produce such flow resistance as to reduce the pressure of lubricating oil from a level of discharge pressure to a level of back pressure being supplied to said back pressure chamber as the lubricating oil travels through said portion of said each of first and second clearances, said back pressure chamber being supplied with oil solely through said first and second clearances and clearances between said vanes and said rotor slits.

2. A vane compressor as claimed in claim 1, wherein said opposite end faces of said rotor each have an annular groove formed therein, said annular groove communicating a corresponding one of said clearances with said back pressure chamber.

3. A vane compressor as claimed in claim 1, further including seal means arranged in said sealing chamber and fitted on said drive shaft for sealing same.

4. A vane compressor as claimed in claim 1 or 2 wherein said suction chamber includes a rear suction chamber defined between said partition member and said rear side block, part of said rear suction chamber forming said oil chamber, said partition member having a through hole formed therein, said covering having a rear end wall formed with said suction port, said discharge port, and a hollow passage defining portion, said hollow passage defining portion having one end aligned with said suction port and another end joined to said partion member in alignment with said through hole therein.

5. A vane compressor as claimed in claim 4, wherein said pump housing having a peripheral wall portion thereof formed with an axially extending suction passage, said suction chamber including a front suction chamber defined between said front head and said front side block and communicating with said rear suction chamber through said suction passage.

6. A vane compressor as claimed in claim 5 wherein said pump inlet includes at least two pump inlets formed in both of said front and rear side blocks, each of said front and rear chambers communicating said pump working chambers on a suction stroke thereof through at least one of said pump inlets formed in a corresponding one of said front and rear side blocks.

7. A vane compressor as claimed in claim 1 or 2 further including first passage means communicating said suction port with said suction chamber, and second passage means communicating said suction port with said sealing chamber, and wherein said suction chamber includes a rear suction chamber defined between said partition member and said rear side block, part of said rear suction chamber forming said oil chamber, said pump housing having a peripheral wall portion thereof formed with an axially extending passage forming part of said first passage means and communicating said suction port with said rear suction chamber.

8. A vane compressor as claimed in claim 7, wherein said suction port is formed in said front head, and said suction chamber includes a front suction chamber defined between said front head and said front side block and disposed around said sealing chamber, said second passage means including a passage communicating said front suction chamber with said sealing chamber.

9. A vane compressor as claimed in claim 8, including a partition wall extending between said front head and said front side block and separating said front suction chamber from said sealing chamber, and wherein said passage of said second passage means is formed by cutting away at least part of said partition wall.

10. A vane compressor as claimed in claim 7, wherein said partition member has a through hole formed therein, said covering having a rear end wall formed with said suction port, said discharge port, and a hollow passage defining portion, said hollow passage defining portion having one end aligned with said suction port and another end joined to said partition member in alignment with said through hole therein, said pump housing having a peripheral wall portion thereof formed with an axially extending passage, said suction chamber including a front suction chamber defined between said front head and said front side block and communicating with said rear suction chamber through said passage of said pump housing.

11. A vane compressor as claimed in claim 7, wherein said front and rear side blocks each have a through hole formed therein and receiving one of said first and second roller bearings, said through hole communicating with a corresponding one of said first and second clearances, said first and second clearances each have a portion extending between said another end of a corresponding one of said lubricating oil feeding passages and a corresponding one of said through holes of said front and rear side blocks, said last-mentioned portion of said each clearance being adapted to produce such flow resistance as to reduce the pressure of lubricating oil from a level of discharge pressure to a level of suction pressure being supplied to said roller bearings as the lubricating oil travels through said last-mentioned portion of said each clearance.

12. A vane compressor as claimed in claim 11, wherein the distance between said another end of each of said lubricating oil feeding passages and a corresponding one of said annular grooves is smaller than the distance between said another end of said each lubricating oil feeding passage and a corresponding one of said through holes of said first and second side blocks.

13. A vane compressor as claimed in claim 2, wherein said portion of each of said first and second clearances is formed by a portion of said each of first and second clearances extending between said another end of said corresponding one of said lubricating oil feeding passages and a corresponding one of said annular grooves.

* * * * *